US009828985B2

(12) United States Patent
Lefebvre et al.

(10) Patent No.: US 9,828,985 B2
(45) Date of Patent: Nov. 28, 2017

(54) METHOD FOR CONTROLLING A COMPRESSED AIR INSTALLATION AND CONTROLLER AND COMPRESSED AIR INSTALLATION FOR EMPLOYING SUCH A METHOD

(75) Inventors: Tine Maria Antoinette Lefebvre, Jette (BE); Johan Georg Urban Pettersson, Tervuren (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 1065 days.

(21) Appl. No.: 12/374,305

(22) PCT Filed: Jun. 21, 2007

(86) PCT No.: PCT/BE2007/000063

§ 371 (c)(1),
(2), (4) Date: Jan. 17, 2009

(87) PCT Pub. No.: WO2008/009072

PCT Pub. Date: Jan. 24, 2008

(65) Prior Publication Data

US 2009/0320929 A1 Dec. 31, 2009

(30) Foreign Application Priority Data

Jul. 18, 2006 (BE) ..... 2006/0393

(51) Int. Cl.

| | |
|---|---|
| ***E03B 5/00*** | (2006.01) |
| ***F04B 41/06*** | (2006.01) |
| ***F04B 49/06*** | (2006.01) |
| ***F04B 49/02*** | (2006.01) |
| ***F04C 23/00*** | (2006.01) |
| ***F04C 28/02*** | (2006.01) |

(52) U.S. Cl.

CPC ..... *F04B 49/065* (2013.01); *F04B 41/06* (2013.01); *F04B 49/022* (2013.01); *F04C 23/001* (2013.01); *F04C 28/02* (2013.01); *Y10T 137/0379* (2015.04); *Y10T 137/86002* (2015.04)

(58) Field of Classification Search

CPC ..... E03B 5/00; F17D 1/04; F04B 1/06; F04B 49/022; F04B 28/02

USPC ..... 137/565.33, 597, 566; 417/28, 113, 112, 417/138, 142, 44.2, 4, 6, 423.4, 50, 49, 417/48, 51, 52, 53

See application file for complete search history.

(56) References Cited

U.S. PATENT DOCUMENTS 2,805,679 A * 9/1957 Schrameck ..... H01H 33/304 137/255

4,502,842 A 3/1985 Currier et al.

(Continued)

FOREIGN PATENT DOCUMENTS

| | | |
|---|---|---|
| JP | 2004116381 A | 4/2004 |
| WO | WO 96/16271 | 5/1996 |
| WO | WO 98/32971 | 7/1998 |

*Primary Examiner* — Chee-Chong Lee

(74) *Attorney, Agent, or Firm* — Bacon & Thomas, PLLC

(57) ABSTRACT

Method for controlling a compressed air unit which consists of several compressed air networks (2 and 3) having at least one commonly controllable component, characterized in that, on the basis of measurement data of at least one of the above-mentioned compressed air networks (2 and 3), at least the above-mentioned common component (11) is controlled by at least one controller (20).

13 Claims, 1 Drawing Sheet

(56) References Cited

U.S. PATENT DOCUMENTS

| | | | | |
|---|---|---|---|---|
| 5,433,238 | A * | 7/1995 | Cannizzaro et al. | 137/14 |
| 7,955,056 | B2 * | 6/2011 | Pettersson | 417/53 |
| 2004/0151593 | A1 | 8/2004 | Saarinen et al. | |

* cited by examiner

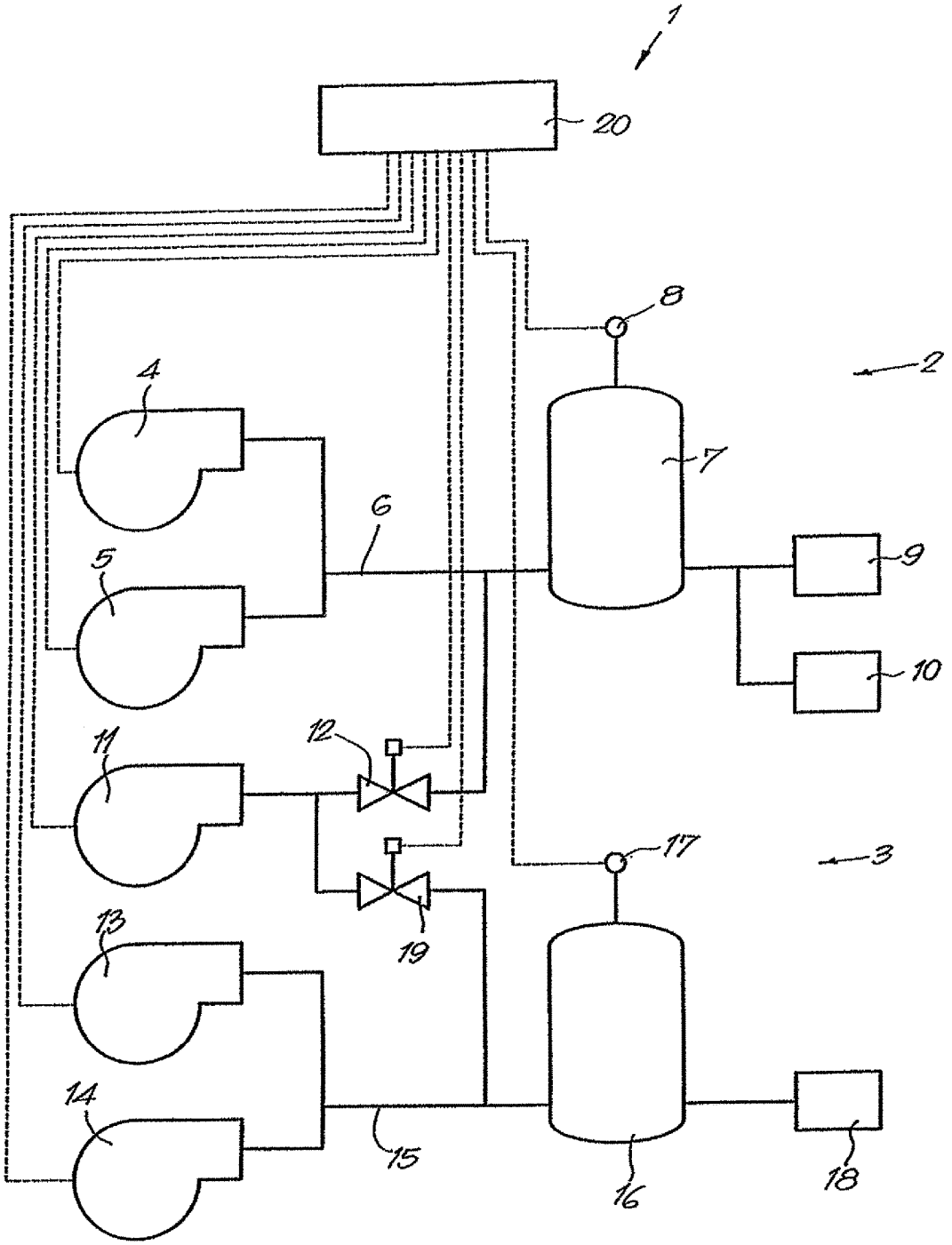
1
20
8
2
4
7
6
9
5
10
12
11
17
3
19
13
14
15
16
18

METHOD FOR CONTROLLING A COMPRESSED AIR INSTALLATION AND CONTROLLER AND COMPRESSED AIR INSTALLATION FOR EMPLOYING SUCH A METHOD

FIELD OF INVENTION

The present invention concerns a method for controlling a compressed air unit.

In particular, the present invention concerns a method for controlling a compressed air unit which consists of several compressed air networks having at least one common and controllable component.

BACKGROUND

By compressed air unit is meant any installation here making use of a compressed gas which is not necessarily restricted to compressed air.

Up to now, it is only known to manually open or close common shut-off valves of said compressed air networks on the basis of whether one or several compressed air users are either or not connected to the above-mentioned compressed air networks.

A disadvantage of such a known method is that it is rather expensive, since staff must always be about to open and close said valves.

Another disadvantage of such a known method is that the components of said compressed air networks consume much energy and wear relatively fast, and that the supplied compressed air has relatively large fluctuations as far as pressure, flow rater temperature and/or dew point are concerned.

The present invention aims to remedy one or several of the above-mentioned and other disadvantages.

SUMMARY

To this end, the present invention concerns a method for controlling a compressed air unit which consists of several compressed air networks having at least one commonly controllable component, whereby, on the basis of measurement data of at least one of the above-mentioned compressed air networks, at least the above-mentioned common component is controlled by at least one controller.

An advantage of such a method according to the invention is that, by providing a continuous adjustment of the above-mentioned common and controllable component, the energy consumption can be restricted and fluctuations in pressure, flow rate and/or dew point of the supplied compressed air are prevented.

As a result, the compressed air unit becomes more flexible, cheaper in acquisition and cheaper during its operation.

Another advantage of such a method according to the invention is that one can save on personnel, whereas a precise, continuous control is made possible.

As the control takes place on the basis of measurement data of at least one of the above-mentioned compressed air networks, the needs of the compressed air users can be responded to very swiftly and accurately, and numerous physical condition parameters of the supplied compressed air can be checked.

The present invention also concerns a controller which is provided with a connection for at least one commonly controllable component that is part of several compressed air networks, whereby this controller is provided with an algorithm which, on the basis of measurement data of at least one of the above-mentioned compressed air networks, controls at least the above-mentioned common component according to the above-mentioned method.

Finally, the present invention further concerns a compressed air unit for applying said method, which compressed air unit consists of several compressed air networks having at least one commonly controllable component, whereby at least the above-mentioned commonly controllable component is connected to at least one controller for controlling said component.

BRIEF DESCRIPTION OF THE DRAWINGS

In order to better explain the characteristics of the present invention, a preferred method according to the invention is described hereafter, with reference to the accompanying drawing, in which a compressed air unit 1 is represented that is controlled according to a method according to the invention.

DETAILED DESCRIPTION OF VARIOUS EMBODIMENTS OF THE DISCLOSURE

In this case, the above-mentioned compressed air unit consists of two compressed air networks 2 and 3.

The above-mentioned first compressed air network 2 in this case comprises a first compressor 4 and a second compressor 5 connected in parallel with the latter, which are connected with their respective outlet passages, via a pipe 6, to a first pressure vessel 7 onto which is connected a pressure sensor 8.

The above-mentioned first pressure vessel 7 is connected with its outlet to a first and a second compressed air user 9, 10 respectively, having the same pressure requirements.

Finally, the first compressed air network 2 comprises a third auxiliary compressor 11 whose outlets are connected via a controllable valve 12 to the above-mentioned pipe 6 between the compressors 4 and 5 on the one hand, and the first pressure vessel 7 on the other hand.

The above-mentioned second compressed air network 3 comprises a fourth compressor 13 and a fifth compressor 14 connected in parallel with the latter, whereby the respective outlets of said compressors 13 and 14, via a common high-pressure tube 15, are connected to a second pressure vessel 16 on which is provided a pressure sensor 17 and to which, at the outlet, is connected a third compressed air user 18 which, in this case but not necessarily, has other pressure requirements than the above-mentioned first and second compressed air users 9 and 10.

Finally, also the second compressed air network 3 comprises the above-mentioned third compressor 11 whose outlet side is connected, via a controlled valve 19, to the above-mentioned high-pressure tube 15 between the above-mentioned compressors 13 and 14 on the one hand, and the second pressure vessel 16 on the other hand.

In this case, each of the above-mentioned compressors 4, 5, 11, 13 and 14 is made controllable, for example as it is driven in a known manner by a motor, not represented in the figures, with an adjustable rotational speed which is connected to a controller 20.

Also the above-mentioned valves 12 and 19 are in this case made controllable, for example as they are driven by means of a servomotor, not represented in the figures, which is connected to the above-mentioned controller 20 as well.

Also the above-mentioned pressure sensors 8 and 17 are in this case connected to the above-mentioned controller 20.

The method for controlling the compressed air unit 1 is characterised in that the above-mentioned controller 20, on the basis of measurement data provided by at least one of the compressed air networks 2 and 3, and in this case on the basis of the measurement data provided by the pressure sensors 8 and 17, controls at least the common auxiliary compressor 11 and preferably but not necessarily also the controllable valves 12 and 19 to selectively supplement a supply of compressed gas to at least one of the compressed air networks 2 and 3.

In this case, also the other compressors 4, 5, 13 and 14 are controlled by this controller 20, but this is not necessarily so according to the invention.

A method according to the invention for controlling a compressed air unit is preferably centralised, meaning that at least one controller determines the operational condition of all the controlled components of the compressed air unit 1.

It is clear, however, that also a distributed control can be applied with a method according to the invention, whereby several controllers are applied, none of which determines the operational condition of all the controllable components.

A method according to the invention can also be made sequential, whereby several of the controllable components of the compressed air unit 1 are put in a predetermined sequence.

With such a sequential method, each time the demands of a compressed air user 9, 10 and/or 18 cannot be met by the already activated components or in case the good working order of the compressed air unit 1 cannot be further guaranteed, a subsequent component of the sequence will be activated.

Conversely, if the working of all the components is no longer required to be able to meet the demands of the above-mentioned compressed air user 9, 10 and/or 18, the last component of the above-mentioned sequence will be disconnected.

According to the invention, it is possible that components of a different type, such as compressed air sources, compressed air users, processing devices for compressed air and compressed air valves are implemented in a separate sequence per type of component, but these different types can also be intermingled in sequences.

According to the invention, the different sequences can be set by an operator and/or they can be defined on the basis of identifiable variables, such as for example on the basis of one or several of the following non-restrictive variables: time, date, pressure, flow rate, dew point, air quality and/or temperature.

According to a special characteristic of a method according to the invention, the different controllable components of the compressed air unit 1 can be controlled such that each of them is active for a certain time span, in order to stagger the wear of said different components and thus extend the life of the compressed air unit 1.

The above-mentioned time settings can be inputted by an operator and/or they can be based on identifiable variables, such as for example on the basis of one or several of the following non-restrictive variables: time, date, pressure, flow rate, dew point, air quality and/or temperature.

In a method according to the invention is preferably implemented an algorithm that makes sure that the maintenance of different components of the compressed air unit 1 can be done simultaneously.

The control of the different components of the compressed air unit 1 can be based on different parameters which influence the maintenance requirements, such as among others the number of working hours and the working conditions.

According to a preferred characteristic of the invention, an energy-saving algorithm is applied with the method for controlling a compressed air unit 1, whereby an optimized energy consumption of at least a part of the compressed air unit 1 is obtained by setting the operational point of one or several of its components such that the energy consumption is as low as possible, while a good working of the compressed air unit 1 is nevertheless guaranteed.

As an option, a method according to the invention can be realised such that the components of the compressed air unit 1 are controlled in such a way that the operating costs, such as for example energy consumption costs, maintenance costs, repair and replacement costs and the like of components of the compressed air unit 1 and/or of the compressed air unit 1 as a whole are always restricted to a minimum.

Finally, in order to apply the method according to the invention, a control algorithm can be used whereby the compressed air unit 1 is controlled such that one or several parameters, with as non-restrictive examples temperature, pressure, dew point, volume, air quality and flow rate values, are conformed to a certain directional value or whereby one or several of these parameters are kept within a certain range by controlling the suitable components by means of the above-mentioned controller 20.

In the given example, the common component of both compressed air networks 2 and 3 is formed of the compressor 11, but it is clear that the invention is not restricted as such and that the above-mentioned commonly controllable component may be formed of at least one of the following components or a combination thereof of the several controllable components: a compressed air user, a compressed air source, a processing device for compressed air or a compressed air valve.

By the term compressed air user is meant any possible user of compressed air, such as for example pneumatic tools.

By the term compressed air source is meant any source of compressed gas, such as for example screw-type compressors, piston compressors, fans and the like which are not restricted to the supply of compressed air, but which can also be applied for any other type of compressed gas.

By a processing device for compressed air is meant any device that is designed to alter the quality or the physical parameters of the compressed air, such as for example dryers, heat exchangers, filters, moisture and oil separators and the like.

By compressed air valves are meant any possible embodiments of controllable valves, valves, shut-off valves, mixing taps, throttling valves and the like.

In the given example, the above-mentioned compressors 4, 5, 11, 13 and 14, the valves 12 and 19 and the pressure sensors 8 and 17 are connected to the above-mentioned controller 20 by means of physical pipes. It is clear that such a connection can also be made wireless and that it does not necessarily have to be realised directly, but that it can also be made indirectly, for example via separate communication units.

According to the invention, the respective components of the compressed air networks 2 and 3 and the controller 20 may also communicate via a communication network.

It is clear that the above-mentioned controller 20 can be made in the shape of a separate unit, as well as in the shape of a built-in element which either or not comprises one or several of the following elements: an arithmetic unit, a memory, a screen, peripherals and/or sensors for data input and/or a communication part for transmitting and receiving signals.

Naturally, the method according to the invention is not restricted to the use of merely one controller 20, but also several controllers can be used to control the either or not common components of the compressed air unit 1.

The present invention is by no means limited to the method described as an example; on the contrary, such a method according to the invention for controlling a compressed air unit and a controller and compressed air unit for applying such a method can be made according to all sorts of variants while still remaining within the scope of the invention.

The invention claimed is:

1. A method for controlling a compressed air unit comprising the steps of:

providing at least two compressed air networks, each of the at least two compressed air networks having at least one main gas compressor and an outlet connected to a pressure vessel, said at least two compressed air networks having at least one common auxiliary controllable component configured to supplement a supply of compressed gas to at least one of the at least two compressed air networks, wherein the at least one common auxiliary controllable component consists of a compressed air source, a processing device for compressed air, a gas compressor, and an outlet connected separately to only the outlets of the compressed air networks via at least a first controllable valve and a second controllable valve;

selecting at least one of the at least two compressed air networks to supplement the supply of compressed gas; and supplementing a supply of compressed gas to the selected one of the at least two compressed air networks by controlling at least one of the first or second controllable valves using at least one controller on a basis of pressure data from at least one of the pressure vessels of the selected compressed air network.

2. The method according to claim 1, wherein the at least one controller determines the operational condition of at least the at least two compressed air networks, the main gas compressors, and the at least one common auxiliary controllable component.

3. The method according to claim 1, wherein the at least one controller comprises a plurality of controllers for controlling the compressed air unit, wherein none of the plurality of controllers determine the operational condition of-at least the at least two compressed air networks, the main gas compressors, and the at least one common auxiliary controllable component.

4. The method according to claim 1, wherein a plurality of controllable components of the compressed air unit are controlled so as to each be operational for a certain time span to thereby stagger the wear of these different controllable components, wherein the plurality of controllable components comprise at least the main gas compressors of the at least two compressed air networks and the at least one common auxiliary controllable component.

5. The method according to claim 1, wherein a plurality of controllable components of the compressed air unit are controlled such that, on the basis of the measurement data, the maintenance of each of said controllable components is carried out simultaneously, wherein the plurality of controllable components comprise at least the main gas compressors of the at least two compressed air networks and the at least one common auxiliary controllable component.

6. The method according to claim 1 further comprising a step of executing an energy saving algorithm wherein an optimized energy consumption for at least a part of the compressed air unit is obtained by setting the operational point of at least one of the at least one main gas compressors of the at least two compressed air networks and the at least one common auxiliary controllable component of the compressed air unit such that the energy consumption will be as low as possible.

7. The method according to claim 1 further comprising a step of executing an algorithm assuring that energy consumption costs, maintenance costs, repair and replacement costs of the at least one main gas compressors of the at least two compressed air networks or the at least one common auxiliary controllable component of the compressed air unit and/or the compressed air unit as a whole are always restricted to a minimum.

8. The method according to claim 1 further comprising a step of executing a control algorithm wherein the compressed air unit is controlled such that at least one parameter is conformed to a certain directional value, wherein the at least one parameter is maintained within a certain range by controlling at least one of the at least one main gas compressors of the at least two compressed air networks or the at least one common auxiliary controllable component of the compressed air unit by the controller.

9. The method according to claim 1, wherein the at least two compressed air networks operate at different pressures.

10. The method according to claim 1, wherein the controlling of the at least one of the first or second controllable valves is continuously adjusted.

11. The method according to claim 1, wherein the pressure vessels are connected to compressed air users.

12. A method for controlling a compressed air unit comprising the steps of:

providing at least two compressed air networks, each of the at least two compressed air networks having at least one main gas compressor and an outlet connected to a pressure vessel, said at least two compressed air networks having at least one common auxiliary controllable component configured to supplement a supply of compressed gas to at least one of the at least two compressed air networks, wherein the at least one common auxiliary controllable component consists of a compressed air source, a processing device for compressed air, a gas compressor, and an outlet connected separately to only the outlets of the at least two compressed air networks via at least a first controllable valve and a second controllable valve;

selecting at least one of the at least two compressed air networks to supplement the supply of compressed gas; and preventing a fluctuation in pressure, flow rate, and/or dew point by supplementing a supply of compressed gas to the selected one of the at least two compressed air networks by continuously controlling the at least one common auxiliary controllable component and at least one of the first or second controllable valves using at least one controller on a basis of pressure data from at least one of the pressure vessels of the selected compressed air network, wherein the at least one controller is connected to at least the at least one common auxiliary controllable component, a pressure sensor configured to measure the pressure data, and the at least first controllable valve and second controllable valve.

13. A method for controlling a compressed air unit comprising the steps of:

providing at least two compressed air networks, each of the at least two compressed air networks having at least one main gas compressor and an outlet connected to a pressure vessel, said at least two compressed air networks having at least one common auxiliary controllable component configured to supplement a supply of compressed gas to at least one of the at least two compressed air networks, wherein the at least one common auxiliary controllable component consists of a compressed air source, a processing device for compressed air, a gas compressor, and an outlet connected separately to only the outlets of the compressed air networks via at least a first controllable valve and a second controllable valve;

selecting at least one of the at least two compressed air networks to supplement the supply of compressed gas;

supplementing a supply of compressed gas to the selected one of the at least two compressed air networks by controlling at least one of the first or second controllable valves using at least one controller on a basis of pressure data from at least one of the pressure vessels of the selected compressed air network; and wherein a plurality of controllable components of the compressed air unit are controlled such that, on the basis of the measurement data, the maintenance of each of said controllable components is carried out simultaneously, wherein the plurality of controllable components comprise at least the main gas compressors of the at least two compressed air networks and the at least one common auxiliary controllable component.

* * * * *